US008707604B2

(12) United States Patent
Troy et al.

(10) Patent No.: US 8,707,604 B2
(45) Date of Patent: Apr. 29, 2014

(54) ANGLED BIPOD FOREGRIP FOR FIREARM

(75) Inventors: Stephen P. Troy, Lee, MA (US); David A. Hewes, Chesterfield, MA (US); Atilla Michael Troy, Lee, MA (US)

(73) Assignee: Troy Industries, Inc., West Springfield, MA (US)

( * ) Notice: Subject to any disclaimer, the term of this patent is extended or adjusted under 35 U.S.C. 154(b) by 26 days.

(21) Appl. No.: 13/469,814

(22) Filed: May 11, 2012

(65) Prior Publication Data

US 2013/0000174 A1 Jan. 3, 2013

Related U.S. Application Data

(60) Provisional application No. 61/484,710, filed on May 11, 2011.

(51) Int. Cl.
*F41C 23/04* (2006.01)
*F41A 23/08* (2006.01)

(52) U.S. Cl.
USPC ..... 42/72; 42/94; 248/169

(58) Field of Classification Search
USPC ..... 42/71.01, 72, 73, 74, 94; 89/37.04; 248/166, 168, 169, 170, 171
See application file for complete search history.

(56) References Cited

U.S. PATENT DOCUMENTS

| | | | | |
|---|---|---|---|---|
| 1,295,688 | A * | 2/1919 | Butler | 42/94 |
| 5,815,974 | A * | 10/1998 | Keng | 42/94 |
| 7,222,451 | B2 * | 5/2007 | Keng et al. | 42/94 |
| 7,676,977 | B1 * | 3/2010 | Cahill et al. | 42/94 |
| 2007/0011932 | A1 * | 1/2007 | Oz | 42/94 |
| 2008/0134560 | A1 * | 6/2008 | Pierce et al. | 42/94 |
| 2010/0307046 | A1 * | 12/2010 | Cheng | 42/94 |
| 2011/0126444 | A1 * | 6/2011 | Keng et al. | 42/94 |
| 2011/0214330 | A1 * | 9/2011 | Potterfield et al. | 42/94 |
| 2011/0265366 | A1 * | 11/2011 | Hinds, Jr. | 42/94 |

* cited by examiner

*Primary Examiner* — Bret Hayes
(74) *Attorney, Agent, or Firm* — Parsons & Goltry; Robert A. Parsons; Michael W. Goltry

(57) ABSTRACT

A bipod foregrip includes a longitudinally extending mounting base constructed to slidingly engage a mounting rail of a firearm. A fixed gripping portion is affixed to the base adjacent the rear end. A movable gripping portion has a first end pivotally attached adjacent a lower extremity and pivotal between a stored orientation and an extended orientation. The opposed end is positioned in abutting engagement with a lower surface of the mounting base in the stored orientation. Two legs form the movable gripping portion in the stored orientation and extend angularly outwardly and downwardly into a bipod rest in the extended orientation.

15 Claims, 9 Drawing Sheets

ANGLED BIPOD FOREGRIP FOR FIREARM

CROSS-REFERENCE TO RELATED APPLICATION

This application claims the benefit of U.S. Provisional Patent Application No. 61/484,710, filed 11 May 2011.

FIELD OF THE INVENTION

This invention relates to bipods for use on firearms.

BACKGROUND OF THE INVENTION

Firearms of the automatic and/or semiautomatic type generally include some form of rest or support, e.g. a tripod or bipod type support, for use during shooting exercises. In the prior art these types of supports are either permanently mounted and must be dismantled to remove or are temporary and, in many cases unstable. In many instances the permanently mounted supports are movable between a stored orientation adjacent the barrel and a use orientation in which they are pivoted so as to extend downwardly from the barrel. Generally, these permanent supports can be difficult to use and inconvenient or distracting while in the stored orientation.

It would be highly advantageous, therefore, to remedy the foregoing and other deficiencies inherent in the prior art.

Accordingly, it is an object of the present invention to provide a new and improved angled bipod foregrip for mounting on firearms.

It is another object of the present invention to provide new and improved angled bipod foregrip that can conveniently be mounted on a firearm and serves as a foregrip when positioned in the stored orientation.

SUMMARY OF THE INVENTION

Briefly, to achieve the desired objects of the instant invention in accordance with a preferred embodiment thereof, a bipod foregrip includes a longitudinally extending mounting base with an upwardly opening dovetail shaped groove in the upper surface constructed to slidingly engage a dovetail mounting rail of a firearm and locking structure designed to hold the mounting base in a selected longitudinal position along the dovetail mounting rail. A fixed gripping portion is affixed to the base adjacent the rear end of the base. A movable gripping portion has a first end pivotally attached adjacent a lower extremity of the fixed gripping portion and an opposed end. The movable gripping portion is pivotal between a stored orientation and an extended orientation. In the stored orientation the opposed end is positioned in abutting engagement with a lower surface of the mounting base. The movable gripping portion includes two legs forming the movable gripping portion in the stored orientation and extending angularly outwardly and downwardly into a bipod rest in the extended orientation. A manually operable locking mechanism is designed to releasably lock the movable gripping portion in either one of the stored orientation or the extended orientation.

The desired objects of the instant invention are further achieved in accordance with an embodiment of a bipod foregrip including a firearm having a dovetail mounting rail. A longitudinally extending mounting base with an upwardly opening dovetail shaped groove in the upper surface is slidingly engaged with the dovetail mounting rail of the firearm and locking structure is designed to hold the mounting base in a selected place along the dovetail mounting rail. A fixed gripping portion is integrally formed with the mounting base adjacent the rear end of the mounting base so as to extend at a convenient rearwardly directed angle downwardly from adjacent the rear end of the mounting base. A movable gripping portion has a first end pivotally attached adjacent a lower extremity of the fixed gripping portion and an opposed end. The movable gripping portion is pivotal between a stored orientation and an extended orientation. The opposed end is positioned in abutting engagement with a lower surface of the mounting base in the stored orientation. The movable gripping portion includes two legs forming the movable gripping portion in the stored orientation and extending angularly outwardly and downwardly into a bipod rest in the extended orientation. A manually operable locking mechanism is designed to releasably lock the movable gripping portion in either one of the stored orientation or the extended orientation. Each of the two legs forming the movable gripping portion include a tubular body portion and a foot portion, the tubular body portion being constructed to telescopingly receive the foot portion therein for movement between a retracted position and an extended position.

The desired objects of the instant invention are further achieved in accordance with a specific embodiment of a bipod foregrip including a longitudinally extending mounting base with an upwardly opening dovetail shaped groove in the upper surface constructed to slidingly engage a dovetail mounting rail of a firearm and locking structure designed to hold the mounting base in a selected place along the dovetail mounting rail. A fixed gripping portion is integrally formed with the mounting base adjacent the rear end of the mounting base so as to extend at a convenient rearwardly directed angle downwardly from adjacent the rear end of the mounting base. A movable gripping portion has a first end pivotally attached adjacent a lower extremity of the fixed gripping portion by a pivotal mounting element pivotally attached to the fixed gripping portion to define a first pivotal axis extending transversely to the longitudinal direction of the mounting base and pivotally attached to the movable gripping portion to define a second pivotal axis extending in a direction perpendicular to the first pivotal axis. The movable gripping portion is pivotal about the first pivotal axis between a stored orientation and an extended orientation and the opposed end is positioned in abutting engagement with a lower surface of the mounting base in the stored orientation. The movable gripping portion includes two legs forming the movable gripping portion in the stored orientation, the two legs being mounted by the pivotal mounting element for pivotal movement about the second pivotal axis into an angularly outwardly and downwardly directed bipod rest position in the extended orientation. A manually operable locking mechanism designed to releasably lock the movable gripping portion in either one of the stored orientation or the extended orientation.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
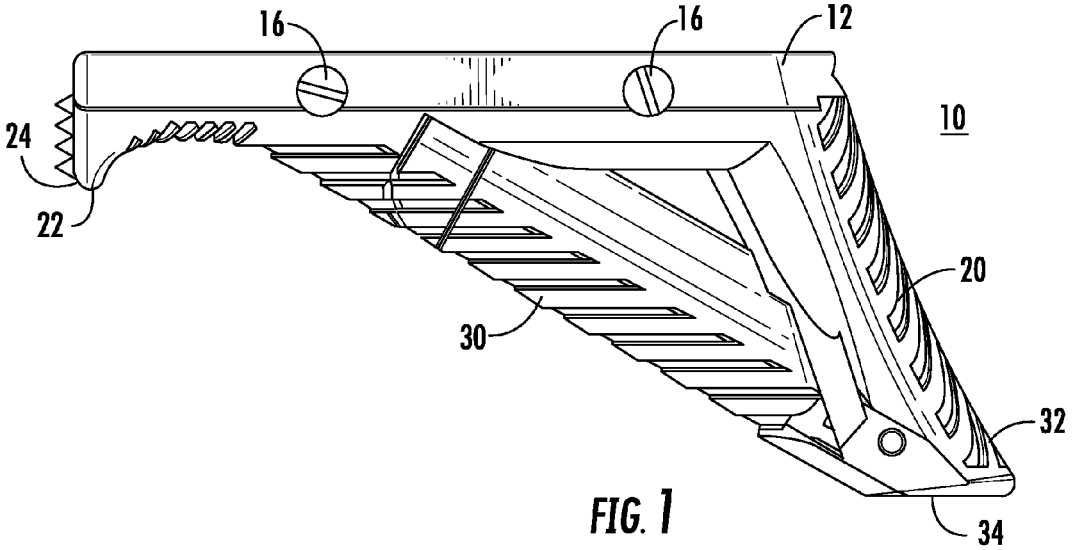
FIG. 1 is a side perspective view of an angled bipod foregrip, folded into a stored or non-use orientation, in accordance with the present invention.
Figure 2:
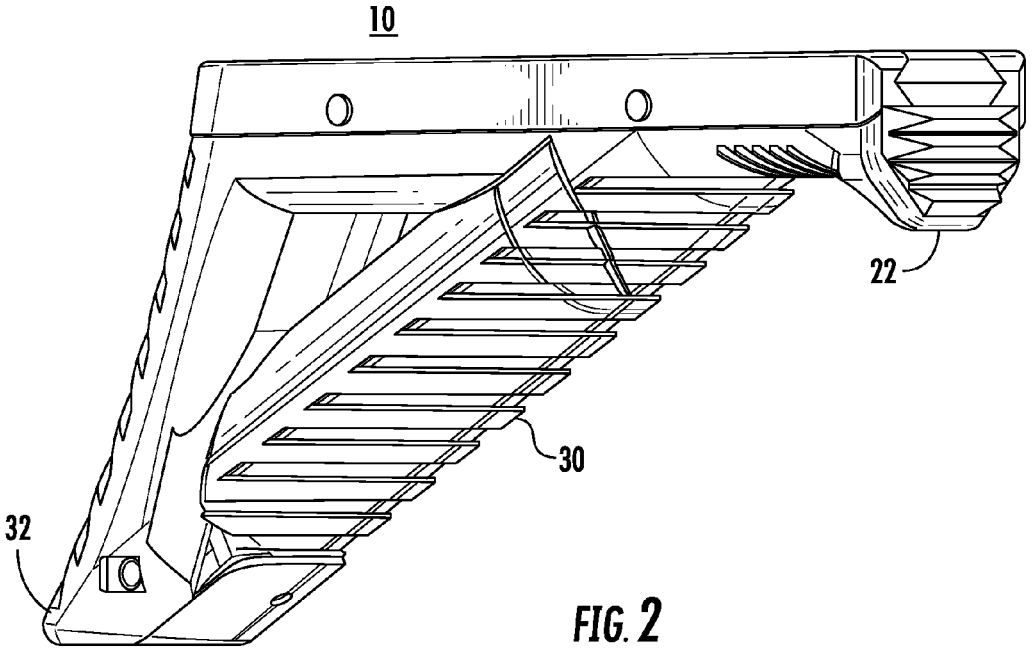
FIG. 2 is a front perspective view of the angled bipod foregrip of FIG. 1.
Figure 3:
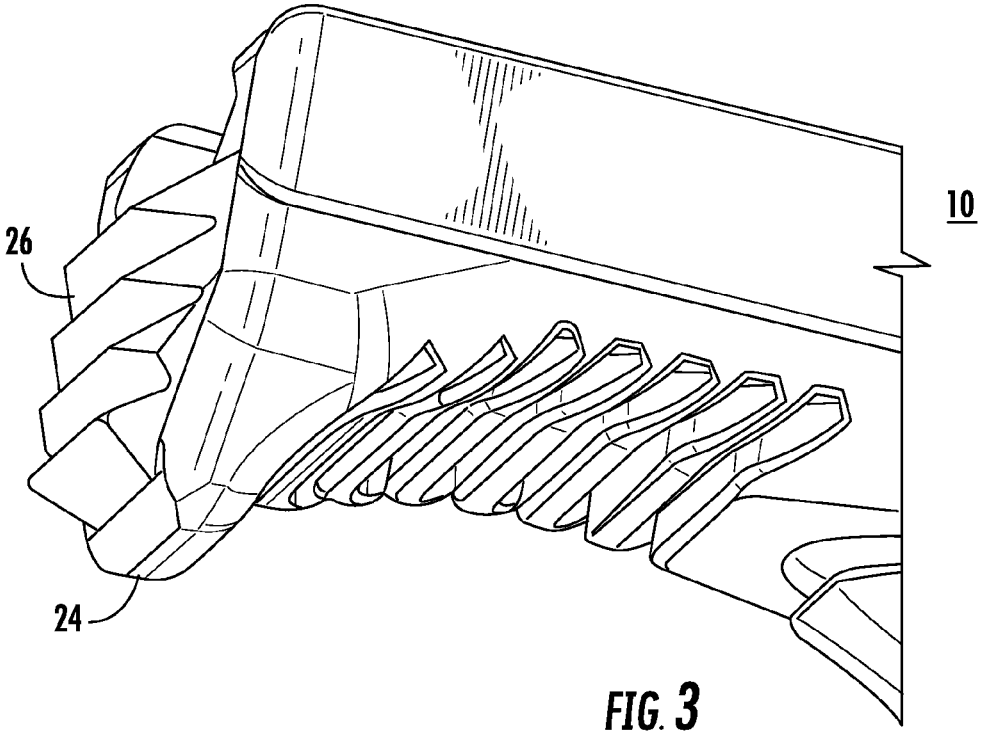
FIG. 3 is an enlarged perspective view of a front portion of the angled bipod foregrip of FIG. 1.
Figure 4:
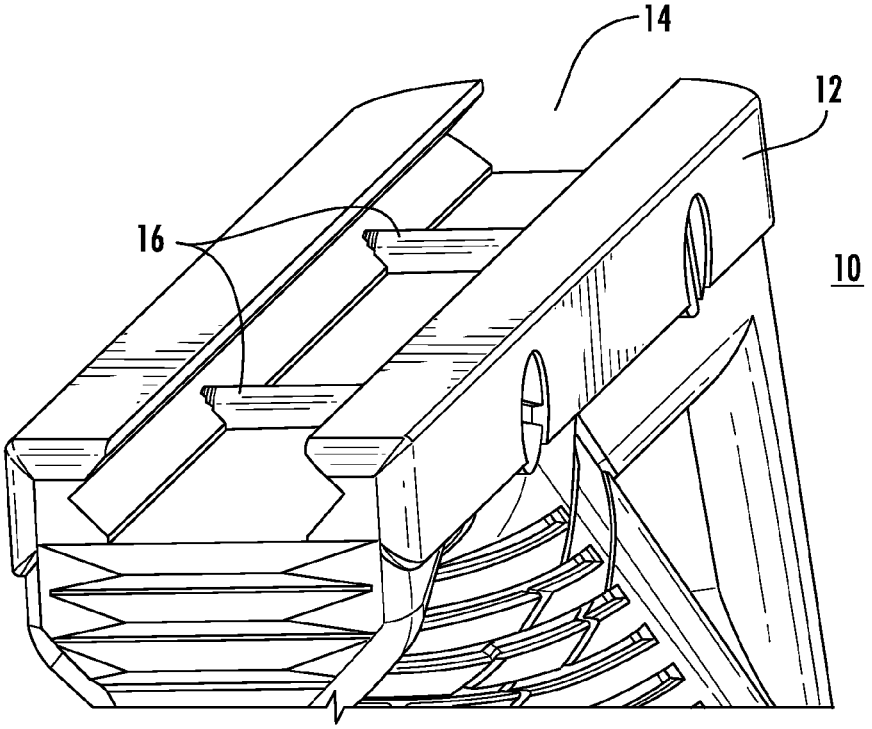
FIG. 4 is an enlarged top perspective view of the angled bipod foregrip of FIG. 1.

Turning to FIGS. 1 through 5, an angled bipod foregrip designated 10 is illustrated in a stored or non-use orientation. Foregrip 10 includes an elongated mounting base 12 with an upwardly opening dovetail shaped groove 14, best seen in FIG. 4, in the upper surface. Base 12 is held in place on a dovetail mounting rail 70 of a firearm 80 by means of two screws 16 that extend laterally through base 12 and concurrently through transverse slots 72 in mounting rail 70 (see FIGS. 16-21). Generally, the mounting of foregrip 10 on a firearm is relatively simple, base 12 is simply slid into a desired position along dovetail mounting rail 70 of a firearm and screws 16 are tightened to firmly clamp foregrip 10 in the selected position.

A fixed gripping portion 20 is integrally formed with base 12 so as to extend at a convenient angle downwardly from the rear end of base 12. Throughout this disclosure when directions (e.g. front, back, rear, etc.) are used, the direction in which the associated firearm is pointed as seen by the user/operator determines the direction being discussed or included (e.g. "forward or front" indicates a direction closest to the muzzle of the barrel and "backward or rear" indicates a direction closest to the stock). Gripping portion 20 is curved and angled to place it close to the mounting rail or base 12 and includes transverse ridges along the rear surface for gripping comfort. Also, the forward end of base 12 extends downwardly into a front lip 22 that is included to aid in preventing the user's hand from sliding forward during use. In addition, a lower surface 24 of lip 22 is flat to allow the user to rest the forward portion of the firearm on a surface during use and a forward surface 26 of lip 22 is provided with a spike-like surface to enhance stability when pressing surface 26 against an exterior surface during use.

Foregrip 10 further includes a movable gripping portion 30 that is pivotally attached at a lower or rear end 32 to the lower end of gripping portion 20 with the opposed end positioned in abutting engagement with a lower surface of base 12 in the stored orientation as seen in FIGS. 1-5. It can be seen that the combined elements, i.e. fixed gripping portion 20 and movable gripping portion 30, also cooperate to provide a flat surface 34 which can be used as a rest for the firearm during use if desired.

Figure 6:
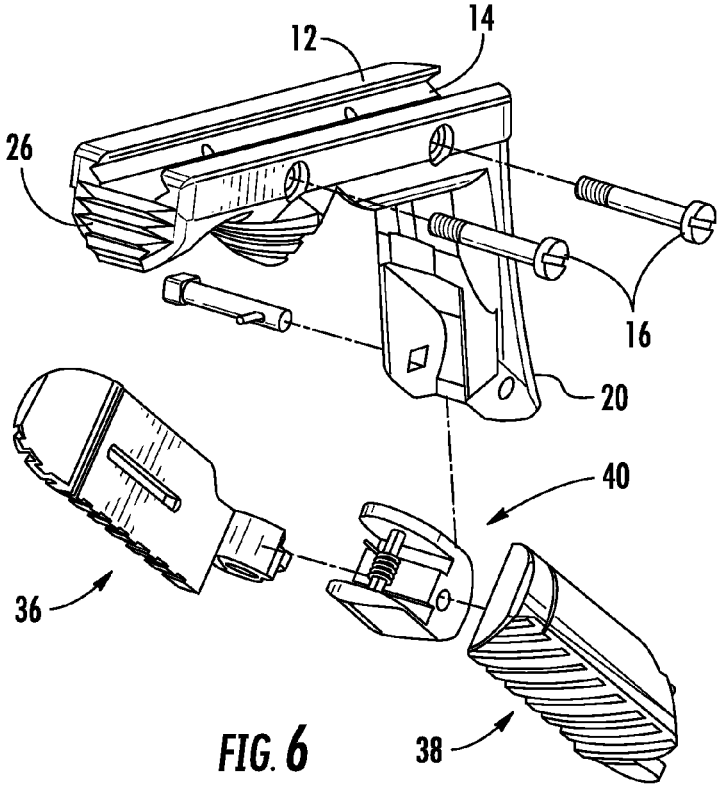
FIG. 6 is an exploded view from the front left of the angled bipod foregrip of FIG. 1, illustrating the two legs and mounting element.
Figure 7:
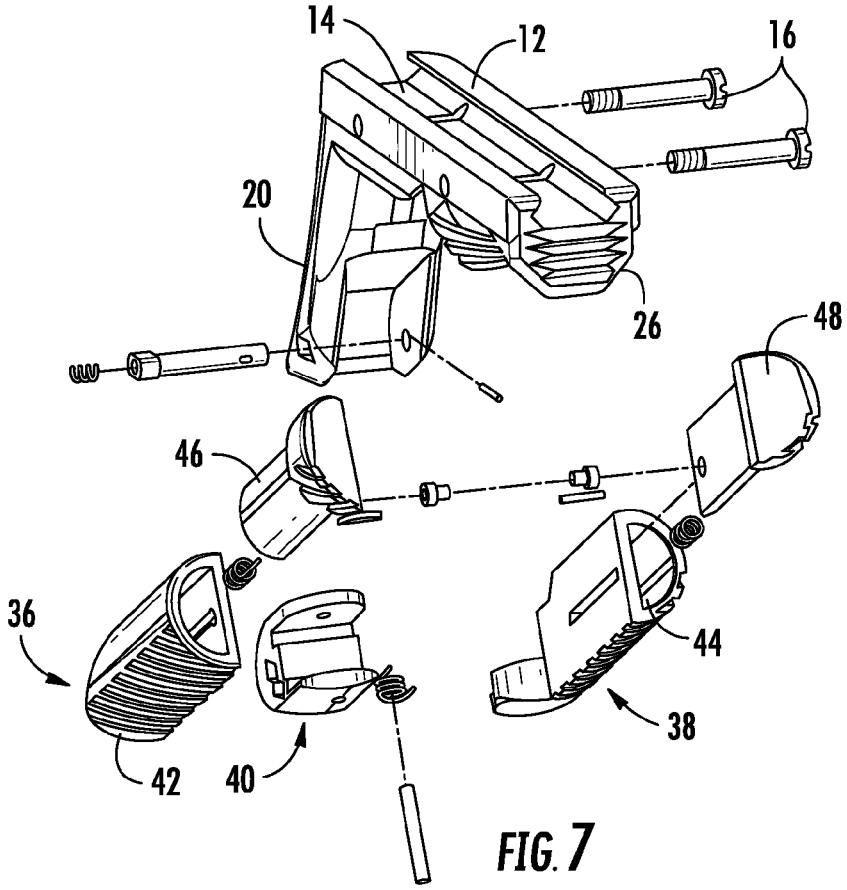
FIG. 7 is an exploded view from the front right of the angled bipod foregrip of FIG. 1, illustrating the components of each of the two legs in an exploded view.

Movable gripping portion 30 includes two legs, generally designated 36 and 38, respectively, which form portion 30 in the stored or folded orientation and form a bipod rest in the unfolded or extended orientation. Turning to FIGS. 6 through 10, exploded views of various portions of movable gripping portion 30 and legs 36 and 38 are illustrated. Referring specifically to FIG. 6, legs 36 and 38 are each illustrated in a stored or compressed orientation and separated from a pivotal mounting element 40. Referring specifically to FIG. 7, legs 36 and 38 are each illustrated with tubular body portions 42 and 44, respectively, exploded from foot portions 46 and 48, respectively.

Figure 8:
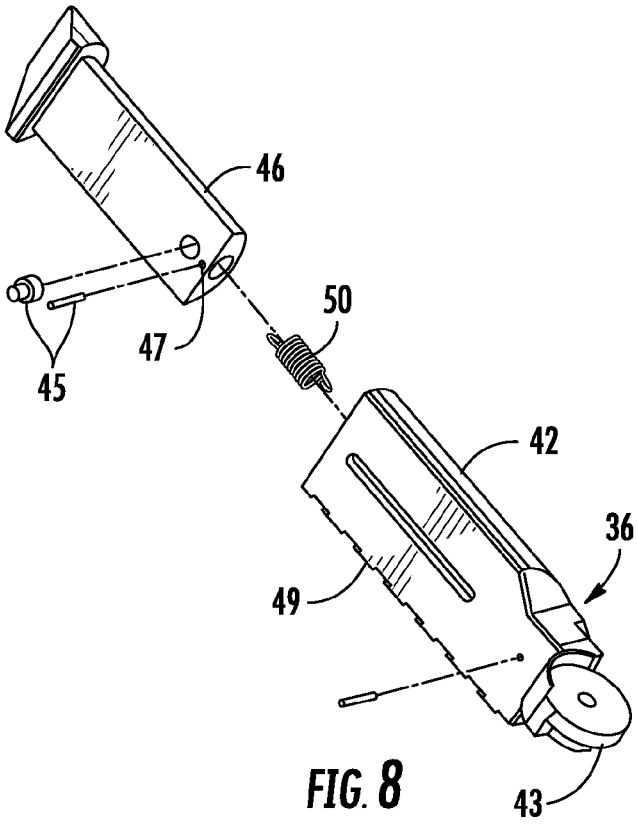
FIG. 8 is an exploded view of a leg.

Referring additionally to FIG. 8, an enlarged exploded view of leg 36 is illustrated It will be understood that leg 38 is substantially the same as leg 36 but is basically a mirror image as will become apparent from the following description. Leg 36 includes an elongated hollow tubular body portion 42 with an open upper end ('upper' in FIG. 8) designed to receive foot portion 46 in a telescoping arrangement therein. The lower end of body portion 42 is closed and terminates in a circular boss 43 designed to pivotally cooperate with pivotal mounting element 40. A pin and compression spring combination 45 are positioned in a hole 47 in the side of foot portion 46 and operate as a detent in cooperation with a slot 49 through a side of body portion 42. A tension spring 50 is attached between the lower end of foot portion 46 and the inner surface at the lower end of body portion 42.

Figure 12:
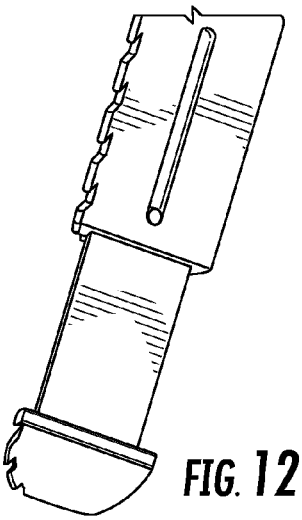
FIG. 12 is a perspective view of a leg in the extended position.
Figure 13:
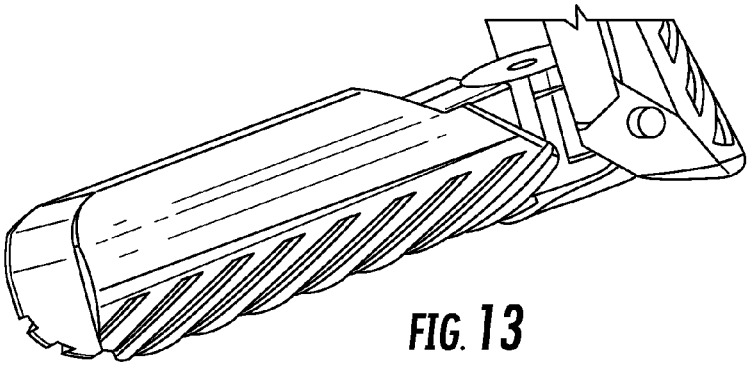
FIG. 13 is a perspective view of a leg in the stored position.

In operation, the lower end of foot portion 46 is telescopingly engaged in the longitudinal opening of body portion 42 with pin and compression spring combination 45 slidingly engaged in slot 49. Tension spring 50 biases foot portion 46 toward a fully retracted position (see FIG. 6). To telescope foot portion 46 outwardly into a fully extended position (see FIG. 12) the user manually depresses pin/spring 45 and pulls foot portion 46 outwardly against the bias of tension spring 50. Once foot portion 46 is in the fully extended or telescoped position, pin/spring 45 engages a special portion of slot 49 and holds foot portion 46 in the extended or telescoped position. To move foot portion 46 back to the retracted position the user simply depresses pin/spring 45 and tension spring 50 automatically retracts foot portion 46. It will be understood that body portion 44 and foot portion 48 of leg 38 include comparable components and operate in a similar manner.

Figure 9:
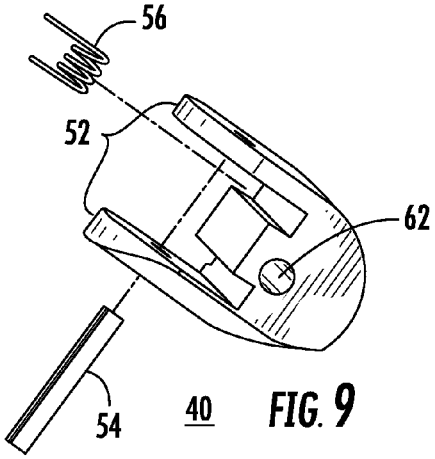
FIG. 9 is an exploded view of the leg mounting structure.
Figure 10:
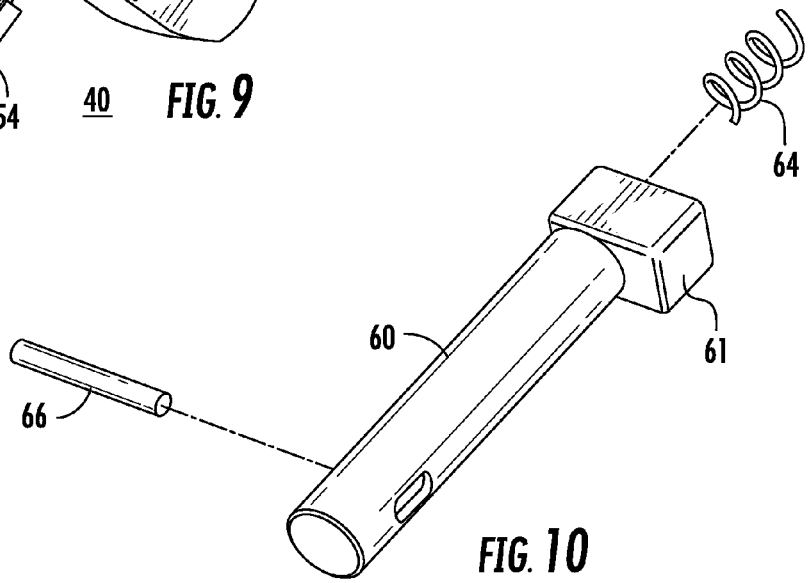
FIG. 10 is an exploded view of the leg locking mechanism.
Figure 14:
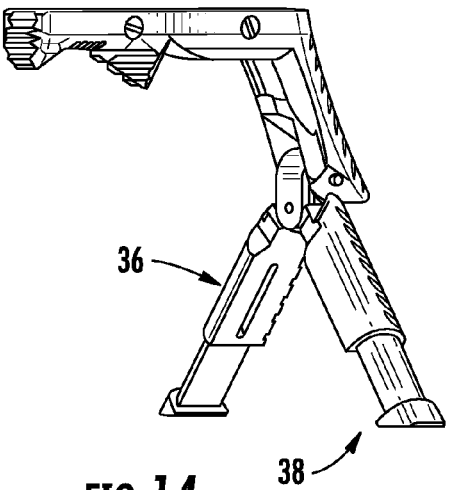
FIGS. 14 and 15 are front and rear perspective views of the angled bipod foregrip in the extended position.
Figure 15:
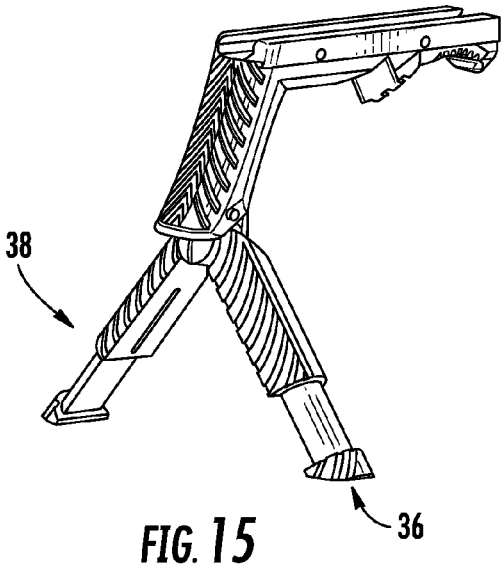

Referring additionally to FIG. 9, it can be seen that pivotal mounting element 40 includes a pair of spaced apart bosses 52 designed to receive bosses 43 of legs 36 and 38 in a parallel orientation therebetween. Bosses 52 have an opening extending laterally therethrough so that with bosses 43 positioned in parallel therebetween a pin 54 is positioned to extend through all four bosses and pivotally mount legs 36 and 38. A torsional spring 56 is positioned between bosses 43 so as to also receive pin 54 therethrough and so as to provide a bias on bosses 43 that tends to force legs 36 and 38 into a spread or bipod orientation (see FIGS. 14 and 15).

Figure 11:
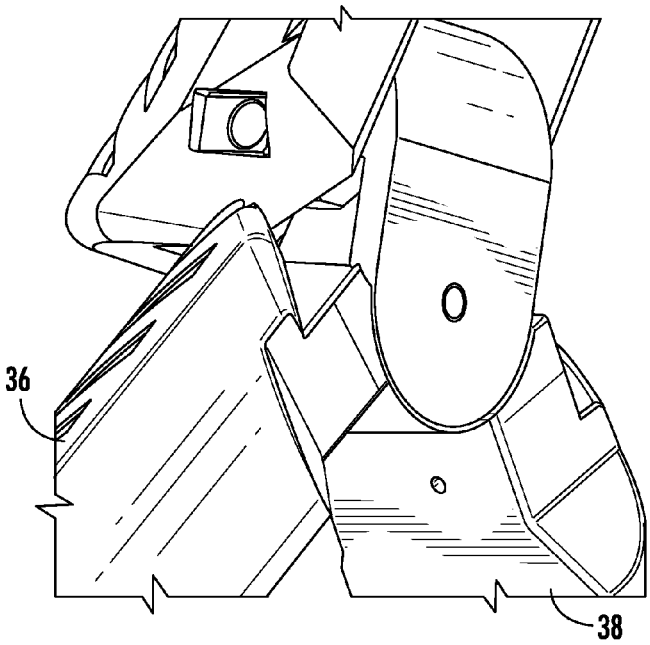
FIG. 11 is an enlarged perspective view of the leg mounting and locking mechanism.

A pin 60 with a rectangularly shaped head 61 extends through an opening 62 in pivotal mounting element 40 in a direction perpendicular to the direction of pin 54. Referring additionally to FIG. 11, pin 60 with pivotal mounting element 40 (and movable gripping portion 30) pivotally positioned thereon is mounted in lower or rear end 32 of fixed gripping portion 20 so that movable gripping portion 30 is rotatable along an axis perpendicular to the longitudinal direction of base 12. The rectangularly shaped head 61 of pin 60 is designed and positioned to engage one of two slots formed in pivotal mounting element 40 (see FIG. 11). Further, a compression spring 64 is positioned to bear against one end of pin 60 and provide a longitudinal bias on pin 60 tending to bias pin 60 toward the two slots and so that rectangularly shaped head 61 remains in which ever of the two slots it is engaged in. A pin 66 is engaged in a perpendicular direction through pin 60 and portions of lower or rear end 32 of fixed gripping portion 20 so as to hold pin 60 fixedly engaged against rotary movement while allowing limited axial or longitudinal movement.

Figure 5:
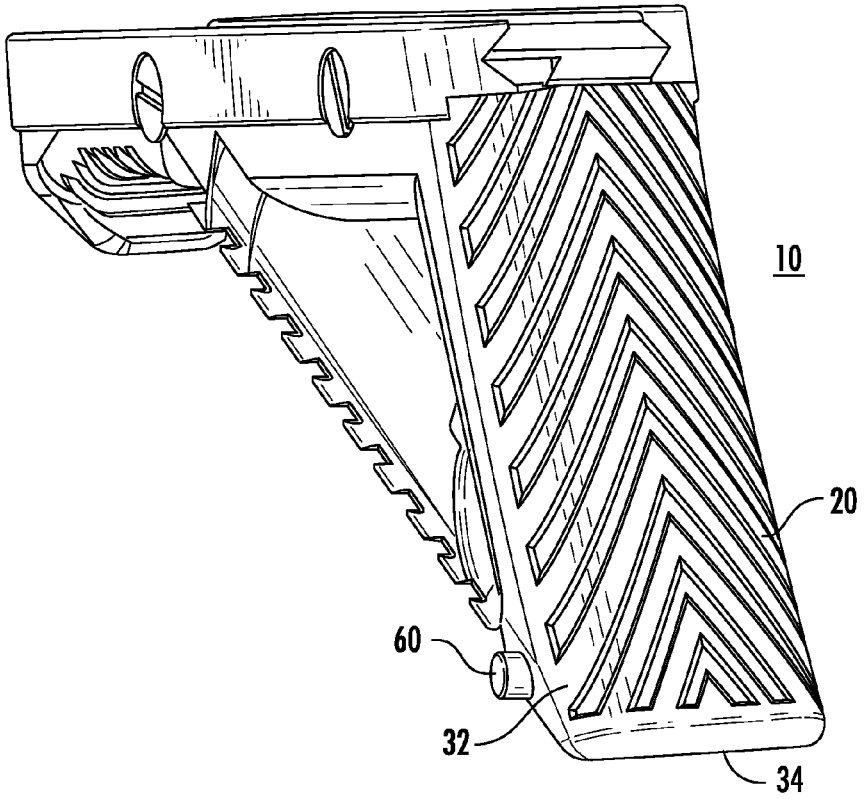
FIG. 5 is a rear perspective view of the angled bipod foregrip of FIG. 1.

With rectangularly shaped head 61 engaged in either of the two slots the end of pin 60 opposite head 61 extends a slight distance out of lower or rear end 32 of fixed gripping portion 20, as illustrated in FIG. 5. Further, as illustrated in FIG. 5, movable gripping portion 30 is positioned in the folded or storage orientation. To move movable gripping portion 30 into the extended orientation the user simply presses the extended end of pin 60 and rotates movable gripping portion 30 downwardly. When the bipod orientation is reached, rectangularly shaped head 61 is biased into the second slot and movable gripping portion 30 is effectively locked in the bipod orientation. Simultaneously, when movable gripping portion 30 is rotated into the bipod orientation, torsion spring 56 biases legs 36 and 38 into the spread or bipod orientation (see FIGS. 14 and 15). At this point the user can manually depress pin/spring 45 on each leg 36 and 38 and then move foot portion 46 and foot portion 48, respectively, into the extended orientation (see FIG. 12 or FIGS. 14 and 15). To move the various components into the stored configuration the procedure is simply reversed.

Figure 16:
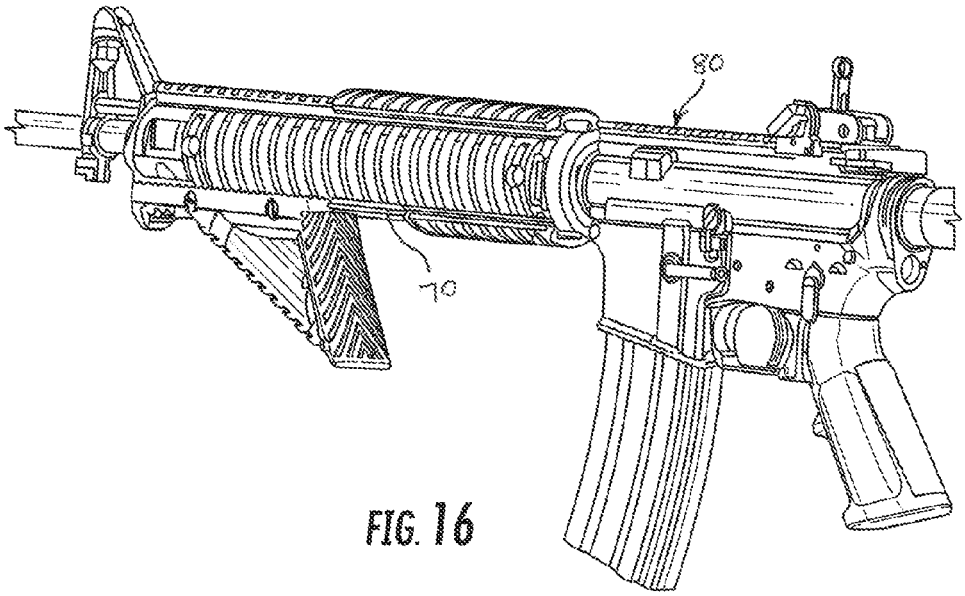
FIGS. 16 through 21 are rear, front, and side perspective views of a firearm with the angled bipod foregrip attached and in the extended and stored orientations.
Figure 17:
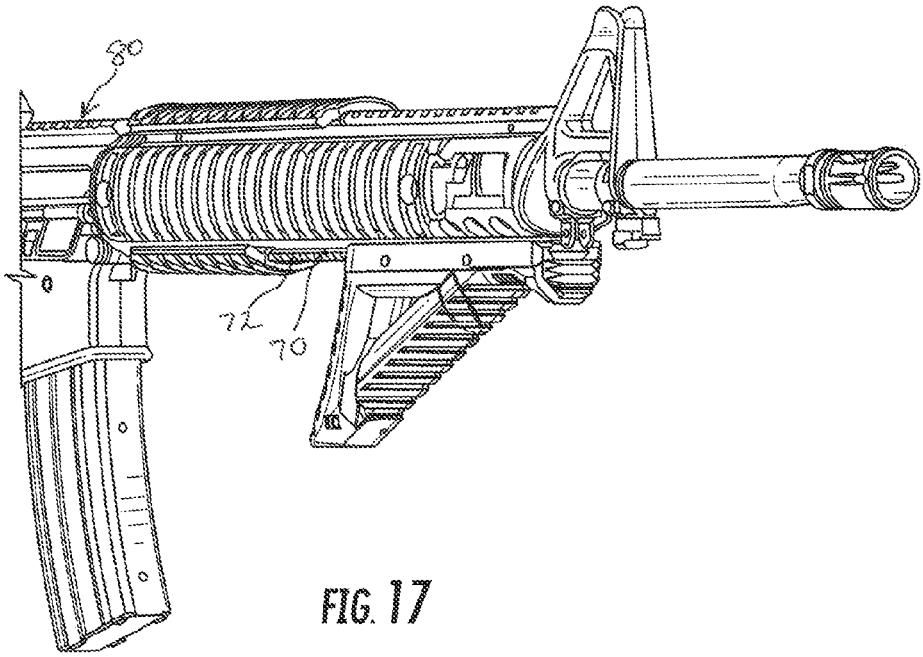
Figure 18:
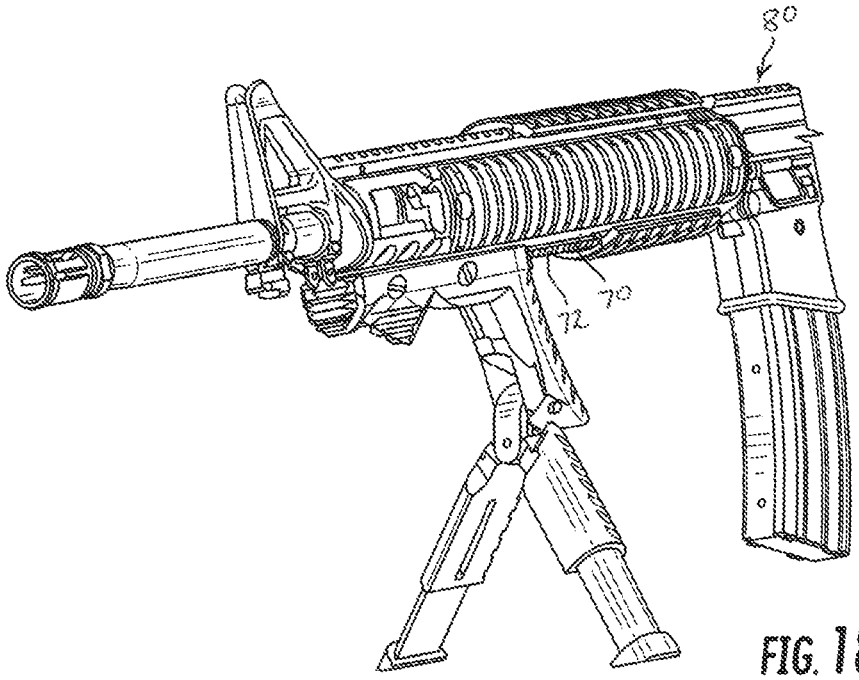
Figure 19:
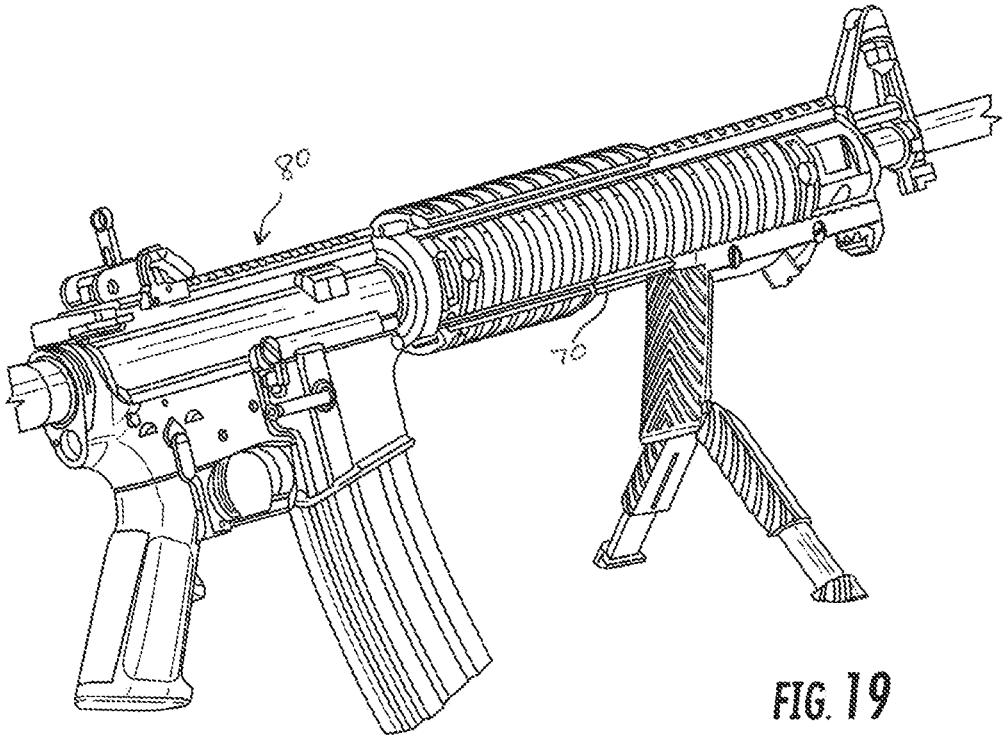
Figure 20:
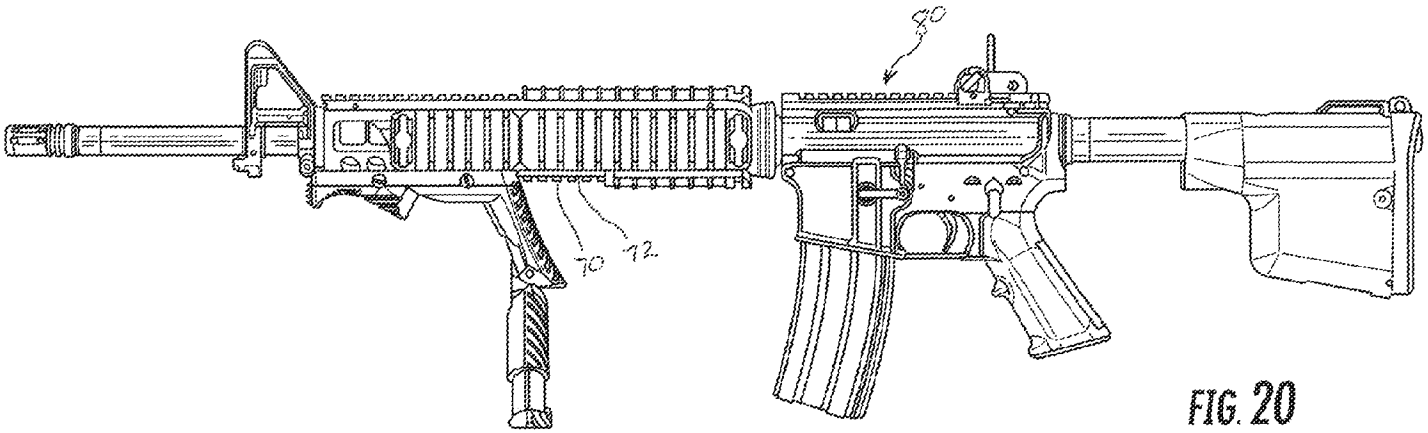
Figure 21:
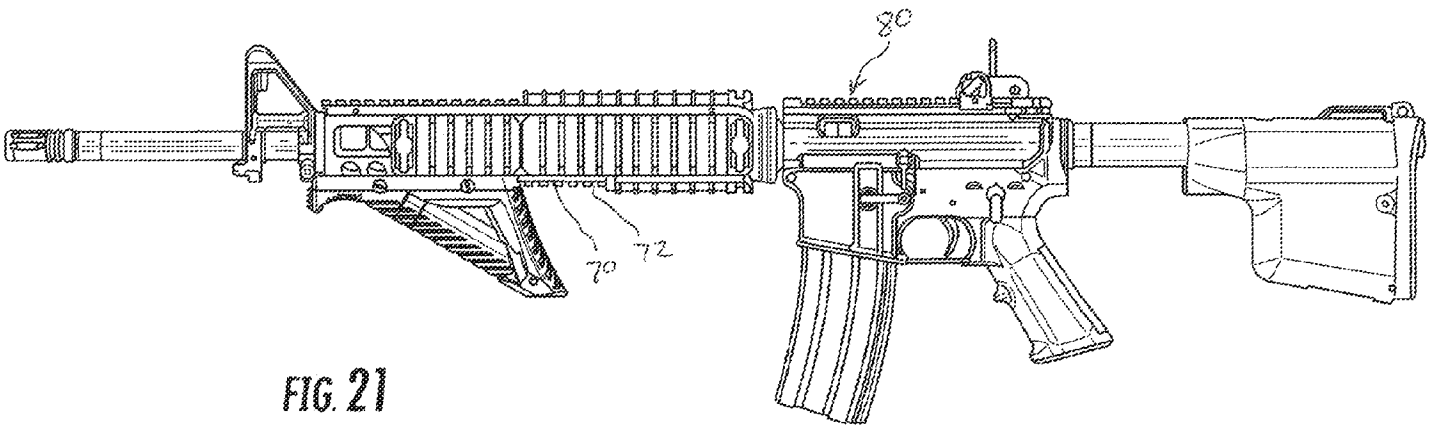

Referring to FIGS. 16 through 21, a firearm is illustrated with the angled bipod foregrip 10 operatively attached in accordance with the present invention. FIGS. 16, 17, and 21 illustrated angled bipod foregrip 10 in the retracted or stored orientation, wherein the novel structure operates like a convenient and comfortable foregrip. In FIGS. 18, 19 and 20 angled bipod foregrip 10 is illustrated in the extended or bipod orientation.

Thus, a new and improved angled bipod foregrip is illustrated and described. The new and improved angled bipod foregrip is designed to provide a user with a more stable and convenient mount and is specifically designed to be easily and conveniently installed on any firearm by means of a standard dovetail rail. The angled bipod foregrip folds into a convenient foregrip in the stored orientation so as not to hamper use of the firearm and extends or unfolds into a sturdy bipod in the use orientation.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

The invention claimed is:

1. A bipod foregrip comprising:

a longitudinally extending mounting base with an upwardly opening dovetail shaped groove in the upper surface constructed to slidingly engage a dovetail mounting rail of a firearm and locking structure designed to hold the mounting base in a selected place along a dovetail mounting rail;

a fixed gripping portion affixed to the base adjacent the rear end of base;

a movable gripping portion having a first end pivotally attached adjacent a lower extremity of the fixed gripping portion and an opposed end, the movable gripping portion being pivotal between a stored orientation and an extended orientation, the opposed end being positioned in abutting engagement with a lower surface of the mounting base in the stored orientation;

the movable gripping portion including two legs forming the movable gripping portion in the stored orientation and extending angularly outwardly and downwardly into a bipod rest in the extended orientation, and a manually operable locking mechanism designed to releasably lock the movable gripping portion in either one of the stored orientation or the extended orientation; and wherein the movable gripping portion pivotally attached to the fixed gripping portion includes a pivotal mounting element pivotally attached to the fixed gripping portion to define a first pivotal axis extending transversely to the longitudinal direction of the mounting base and pivotally attached to the movable gripping portion to define a second pivotal axis extending in a direction perpendicular to the first pivotal axis.

2. A bipod foregrip as claimed in claim 1 wherein the fixed gripping portion is integrally formed with the mounting base so as to extend at a convenient rearwardly directed angle downwardly from adjacent the rear end of the mounting base.

3. A bipod foregrip as claimed in claim 1 wherein the locking structure includes at least one screw that extends laterally through the mounting base in the upwardly opening dovetail shaped groove for engagement with transverse slots of the mounting rail.

4. A bipod foregrip as claimed in claim 1 including a torsional spring positioned between the two legs so as to provide a bias tending to force the two legs into a spread or bipod orientation with the movable gripping portion pivoted into the extended orientation.

5. A bipod foregrip as claimed in claim 1 wherein the two legs are each pivotally attached to the pivotal mounting element for pivotal movement about the second pivotal axis.

6. A bipod foregrip as claimed in claim 5 wherein the movable gripping portion is pivotally attached to the fixed gripping portion by the manually operable locking mechanism for limited pivotal movement about the first pivotal axis.

7. A bipod foregrip as claimed in claim 6 wherein the manually operable locking mechanism is constructed to limit pivotal movement of the movable gripping portion between the stored orientation and the extended orientation and the manually operable locking mechanism is further constructed to releasably lock the movable gripping portion in either one of the stored orientation or the extended orientation.

8. A bipod foregrip as claimed in claim 7 wherein the manually operable locking mechanism includes a pivot pin with an attached rectangularly shaped element, the locking mechanism further including a pair of slots defined in a position to receive the rectangularly shaped element, the pair of slots being positioned to engage the rectangularly shaped element in one of the pair of slots with the movable gripping portion pivoted into the stored orientation and to engage the rectangularly shaped element in the other of the pair of slots with the movable gripping portion pivoted into the extended orientation.

9. A bipod foregrip as claimed in claim 8 wherein the pivot pin is mounted for limited axial movement whereby the rectangularly shaped element is released from either of the pair of slots.

10. A bipod foregrip as claimed in claim 1 wherein each of the two legs forming the movable gripping portion include a tubular body portion and a foot portion, the tubular body portion being constructed to telescopingly receive the foot portion therein for movement between a retracted position and an extended position.

11. A bipod foregrip comprising:

a longitudinally extending mounting base with an upwardly opening dovetail shaped groove in the upper surface constructed to slidingly engage a dovetail mounting rail of a firearm and locking structure designed to hold the mounting base in a selected place on a dovetail mounting rail;

a fixed gripping portion integrally formed with the mounting base adjacent the rear end of the mounting base so as to extend at a convenient rearwardly directed angle downwardly from adjacent the rear end of the mounting base;

a movable gripping portion having a first end pivotally attached adjacent a lower extremity of the fixed gripping portion by a pivotal mounting element pivotally attached to the fixed gripping portion to define a first pivotal axis extending transversely to the longitudinal direction of the mounting base and pivotally attached to the movable gripping portion to define a second pivotal axis extending in a direction perpendicular to the first pivotal axis, the movable gripping portion being pivotal about the first pivotal axis between a stored orientation and an extended orientation, the opposed end being positioned in abutting engagement with a lower surface of the mounting base in the stored orientation; and the movable gripping portion including two legs forming the movable gripping portion in the stored orientation, the two legs being mounted by the pivotal mounting element for pivotal movement about the second pivotal axis into an angularly outwardly and downwardly directed bipod rest position in the extended orientation, and a manually operable locking mechanism designed to lock the movable gripping portion in either one of the stored orientation or the extended orientation.

12. A bipod foregrip as claimed in claim 11 wherein the locking structure includes at least one screw that extends laterally through the mounting base in the upwardly opening dovetail shaped groove for engagement with transverse slots of the mounting rail.

13. A bipod foregrip as claimed in claim 11 including a torsional spring positioned between the two legs so as to provide a bias tending to force the two legs into the bipod rest position with the movable gripping portion pivoted into the extended orientation.

14. A bipod foregrip as claimed in claim 1 wherein each of the two legs forming the movable gripping portion include a tubular body portion and a foot portion, the tubular body portion being constructed to telescoping receive the foot portion therein for movement between a retracted position and an extended position.

15. A bipod foregrip comprising:

a firearm having a dovetail mounting rail with transverse slots;

a longitudinally extending mounting base with an upwardly opening dovetail shaped groove in the upper surface slidingly engaged with the dovetail mounting rail of the firearm and locking structure designed to hold the mounting base in a selected place on the dovetail mounting rail by engaging the transverse slots of the mounting rail;

a fixed gripping portion integrally formed with the mounting base adjacent the rear end of the mounting base so as to extend at a convenient rearwardly directed angle downwardly from adjacent the rear end of the mounting base;

a movable gripping portion having a first end pivotally attached adjacent a lower extremity of the fixed gripping portion and an opposed end, the movable gripping portion being pivotal between a stored orientation and an extended orientation, the opposed end being positioned in abutting engagement with a lower surface of the mounting base in the stored orientation;

the movable gripping portion including two legs forming the movable gripping portion in the stored orientation and extending angularly outwardly and downwardly into a bipod rest in the extended orientation, and a manually operable locking mechanism designed to lock the movable gripping portion in either one of the stored orientation or the extended orientation; and each of the two legs forming the movable gripping portion including a tubular body portion and a foot portion, the tubular body portion being constructed to telescoping receive the foot portion therein for movement between a retracted position and an extended position.

* * * * *